US006132279A

United States Patent [19]

Horiuchi et al.

[11] Patent Number: 6,132,279

[45] Date of Patent: Oct. 17, 2000

[54] HIGH-PRESSURE DISCHARGE LAMP AND MANUFACTURING METHOD THEREOF

[75] Inventors: Makoto Horiuchi, Sakurai; Yuriko Kaneko, Nara; Mamoru Takeda, Kyoto, all of Japan

[73] Assignee: Matsushita Electric Industrial Co., Ltd., Osaka, Japan

[21] Appl. No.: 09/039,424

[22] Filed: Mar. 16, 1998

[30] Foreign Application Priority Data

Mar. 17, 1997 [JP] Japan ..... 9-062661

[51] Int. Cl.[7] ..... H01J 9/00; H05B 33/10

[52] U.S. Cl. ..... 445/26; 445/22

[58] Field of Search ..... 445/22, 26

[56] References Cited

U.S. PATENT DOCUMENTS

| | | | |
|---|---|---|---|
| 2,244,960 | 6/1941 | Nelson . | |
| 3,419,947 | 1/1969 | Gottschalk et al. | 445/26 |
| 3,685,880 | 8/1972 | Sobieski | 316/19 |
| 4,086,075 | 4/1978 | Ekkelboom et al. | 65/40 |
| 4,389,201 | 6/1983 | Hansler et al. | 445/26 |
| 5,108,333 | 4/1992 | Heider et al. | 445/26 |
| 5,192,239 | 3/1993 | Graser | 445/21 |
| 5,286,227 | 2/1994 | Numajiri et al. | 445/26 |
| 5,505,648 | 4/1996 | Nagasawa et al. | 445/26 |
| 5,877,591 | 3/1999 | Nagata et al. | 313/634 |

FOREIGN PATENT DOCUMENTS

| | | |
|---|---|---|
| 0 818 804 | 1/1998 | European Pat. Off. . |
| 2100245 | 3/1972 | France . |
| 197 10204 | 10/1997 | Germany . |
| 58-89756 | 5/1983 | Japan . |
| 7-262967 | 10/1995 | Japan . |

*Primary Examiner*—Nimeshkumar D. Patel
*Assistant Examiner*—Michael J. Smith
*Attorney, Agent, or Firm*—Wenderoth, Lind & Ponack, L.L.P.

[57] ABSTRACT

A method for manufacturing a high-pressure discharge lamp of the double-ended type having excellent resistance to high-pressure and wherein the internal diameter of a portion of the high-pressure discharge lamp where a light-emitting section and a side tube are adjacent can be reduced without restricting the maximum diameter of an electrode on a side where it projects into the light-emitting section. An electrode assembly 105 is arranged within an evacuated glass bulb 2 such that an end of electrode 102 where a coil 102*b* is wound is positioned within the light-emitting section 3. In this condition, the portion where the light-emitting section 3 and the side tube 4*a* (4*b*) are adjacent is heated by a burner 300. The internal diameter of the side tube 4*a* (4*b*) can thereby be formed with a reduced-diameter section 7, whose diameter is smaller than that of the electrode rod 102*a* without restricting the diameter at the location of the coil 102*b*.

13 Claims, 13 Drawing Sheets

HIGH-PRESSURE DISCHARGE LAMP AND MANUFACTURING METHOD THEREOF

BACKGROUND OF THE INVENTION

1. Field of the Invention

The present invention relates to a double-ended high-pressure discharge lamp and method of manufacturing it.

2. Description of the Related Art

In recent years, liquid crystal projectors have become well known for displaying enlarged projected images of letters and drawings, etc. Since such image projection devices require a prescribed optical output, high-pressure discharge lamps of high luminance are usually employed as the light source. Typically, such a lamp is combined with a reflecting mirror. Recently, in order to improve the convergence of the reflecting mirror, shortening of the arc length of the high-pressure discharge lamp has been demanded. However, such shortening of the arc length is associated with a drop in the lamp voltage, so if it is desired to operate the lamp with the same lamp power, lamp current must be increased. Increasing the lamp current leads to increased electrode loss and creates evaporation of the electrode material, resulting in early deterioration of the electrode, i.e. tends to shorten the life of the lamp. For these reasons, if the arc length is to be shortened, usually the mercury vapor pressure during lamp operation is increased, in order to avoid a drop in lamp voltage (increase in lamp current).

If the mercury vapor pressure during lamp operation is increased, it is necessary to construct the lamp in such a way that it will not break under this high operating pressure. A powerful means for preventing such lamp breakage is disclosed at page 111 of the Symposium Proceedings of The 7th International Symposium on the Science and Technology of Light Sources (1995). An outline of the details of this disclosure will be given using FIG. 7A and 7B.

FIG. 7A shows the construction of a prior art high-pressure discharge lamp 130. 100 is a practically spherical light-emitting section made of quartz glass and 101 are side tubes likewise made of quartz glass extending from the light-emitting section 100. 102 are tungsten electrodes, 103 are molybdenum foils, and 104 are molybdenum external leads. These elements constitute electrode assemblies 105, wherein the electrode 102 at one end of each molybdenum foil 103 projects into light-emitting section 100 and the other end of each molybdenum foil 103 is connected to one of the molybdenum external lead 104. The sealing of the discharge lamp in an air-tight manner is effected at the locations of the molybdenum foils 103 onto side tubes 101. Electrodes 102 each comprise a tungsten electrode rod 102*a* of diameter 0.9 mm and a tungsten coil 102*b* wound onto the electrode rod 102*a* in the vicinity of the end that projects into the light-emitting section 100. The external diameter L of the electrodes 102 with coils 102B would onto them is about 1.4 mm. A sealed-in material 120 comprising mercury or metal halide and argon gas (not shown) is sealed into the light-emitting section 100.

FIG. 7B is a cross-sectional view taken along a line VIIB—VIIB shown in FIG. 7A. Essentially, it is not possible to achieve perfect adhesion between the tungsten electrodes 102 and quartz glass, so a non-adhering part 107 is produced around each electrode 102. The width of this non-adhering part 107 is indicated by W. Such a cross-sectional view can be observed at any arbitrary cross-section in the range A–A' of FIG. 7A, i.e. from about the boundary of the light-emitting section 100 and the side tube 101 to the end of the molybdenum foil 103 (on the side where electrode 102 is connected).

In FIG. 7A, if the pressure within the light-emitting section 100 when the lamp 130 is operated is P (pressure P acts generally in the directions of the arrows 160 in the light-emitting section 100), as shown by arrows 170 in FIG. 7B, a pressure Pmax (>P) larger than the pressure P generally indicated by the arrows 160 acts on this non-adhering part 107 (stress concentration phenomenon). Consequently, even if the pressure P within the light-emitting section 100 when the lamp 130 is operated is smaller than the breaking strength Plimit (considered to be about 400 atmospheres to 600 atmospheres, this breaking strength decreases if application of pressure is continued for a long time) of the glass that forms the light-emitting section, it is continued for a long time) of the glass that forms the light-emitting section, it is possible for a pressure exceeding the breaking strength of the glass to act at non-adhering part 107 (Pmax>Plimit>P). If this happens, the glass of the non-adhering part 107 breaks and lamp 130 is destroyed.

According to the disclosure, the magnitude of the pressure Pmax acting on non-adhering part 107 generally indicated by the arrows 170 due to stress concentration increases in proportion to the square root of the width W of non-adhering part 107 (Pmax $P \times W^{1/2}$). Consequently, if for example a pressure P of the same magnitude within light-emitting section 100 is considered, reducing the width W of non-adhering part 107 reduces the pressure Pmax acting on non-adhering part 107 and so increases the margin (Plimit–Pmax) with respect to the breakage strength Plimit of the glass, resulting in a lamp which is less likely to be destroyed (as described above, the breaking strength Plimit decreases if pressure continues to be applied to the glass for a long period, so some such margin is necessary for a lamp that is operated at high-pressure when operated to avoid being destroyed over a long period).

Conversely, if the width of the non-adhering part 107 is not changed, and the lamp 130 is operated with high-pressure P within light-emitting section 100, since the pressure Pmax acting on the non-adhering part 107 is large, the margin (Plimit–Pmax) with respect to the breaking strength Plimit of the glass becomes small, so the lamp can be easily destroyed.

From another point of view, considering the margin (Plimit–Pmax) with respect to a glass breaking strength Plimit of the same size, if the width W of the non-adhering part 107 is decreased, the pressure P within the light-emitting section 100 may be allowed to have correspondingly larger values. That is, lamp 130 can be operated (lit) with a higher pressure.

Due to the above, the extent to which stress concentration can be reduced by decreasing width W of this non-adhering part 107 is a vital point in preventing destruction when the lamp operating pressure is made high.

Conventionally, therefore lamps were manufactured in which the width W of the non-adhering part 107 was reduced by a method as disclosed in, for example, Early Japanese Patent Publication H. 7-262967 in order to prevent destruction of the lamp when this was operated with raised pressure in order to shorten the arc length. This prior art method of manufacture is described below.

FIGS. 8A, 8B, 8C and 8D are views given in illustration of an outline of the conventional method of manufacture of a high-pressure discharge lamp 130.

A prescribed light-emitting section 100 is formed by thermally expanding a quartz glass tube constituted by a glass bulb 110 in FIG. 8A manufactured in a separate process. Side tubes 101 are constituted by undeformed quartz glass attached to both ends of light-emitting section 100. While rotating this glass bulb 110 as shown by arrow 115 on a rotatable chuck, not shown, that grips both ends of side tubes 101, the boundary regions of light-emitting section 100 and side tubes 101 are heated by burners generally shown by arrow 111. Reduced-diameter sections 113 indicated by the shaded regions in which the internal diameter at that location is smaller, are formed by applying pressure to softened locations of side tubes 101 by means of freely rotating carbon heads 112.

After reduced-diameter sections 113 have been formed in the vicinity of both ends of light-emitting section 100 as described above, next, as shown in FIG. 8B, electrode assemblies 105 are inserted into side tubes 101 such that one end of electrode 102 constituting part of electrode assembly 105 is positioned within light-emitting section 100. Then, by heating the locations of molybdenum foil 103 to soften the glass sufficiently by means of burners generally indicated by arrows 121 over a suitable length from the vicinity of reduced-diameter section 113 (near the molybdenum foil 103) to external leads 104, the electrode assemblies 105 are sealed into the side tube 101 by clamping with a pair of clamping elements, not shown, or by compressing to a flattened shape. Molybdenum foil 103 having a thickness of about 20 microns expands, filling up the gap with the glass so that gas-tightness is maintained at the location of the molybdenum foil 103.

Next, as shown in FIG. 8C, material 120 to be sealed-in is inserted into light-emitting section 100 from side tubes 101 which are currently as yet unsealed and electrode assemblies 103 are then inserted into side tubes 101. In this condition, just as in FIG. 8B, the side tubes from reduced-diameter sections 113 to external leads 104 are softened by heating with burners, generally indicated by arrows 121, and the electrode assemblies 105 are sealed onto the side tube 101 by clamping with a pair of clamping elements, not shown, or by compressing to a flattened shape to complete the conventional high-pressure discharge lamp 130, shown in FIG. 8D, in the same way as in FIG. 7A.

FIG. 9 is a detailed view of the vicinity of the boundary (portion A of FIG. 7A or FIG. 8D) of light-emitting section 100 and side tube 101 of a conventional lamp 130. As described above, since essentially it is not possible to achieve perfect adhesion between the tungsten electrode 102 and quartz glass, a gap with respect to the glass is formed around the periphery of electrode 102 (non-adhering part 107 in FIG. 7B). As shown in FIG. 9, the width of this gap is not uniform, but in the case of a lamp manufactured by the conventional method of manufacture described above, the gap is largest in the vicinity of the boundary of light-emitting section 100 and side tube 101 and diminishes towards the molybdenum foil 103. The gap's greatest width is called Wmax. The greatest pressure (concentrated stress) Pmax ( $Wmax^{1/2}$) acts where this width is largest.

In the prior art method of manufacture disclosed in Early Japanese Patent Publication H. 7-262967 described above, electrode assemblies 105 are inserted from side tubes 101 after diameter reduction of the boundary region of light-emitting section 100 and side tube 101 to form the reduced-diameter sections 113 and one end of electrodes 102 must be positioned within the light-emitting section 100. Consequently, lamps can only be manufactured wherein the width Wmax of the gap (non-adhering part 107) in the vicinity of the boundary of light-emitting section 100 and side tube 101 is always larger (Wmax>L) than the diameter L=1.4 mm (>d) of the location where coil 102*b* is wound onto the electrode rod 102*a* of the greatest diameter on the side projecting into light-emitting section 100 of electrode 102, i.e. diameter d=0.9 mm. Consequently in a conventional high-pressure discharge lamp 130 there was the problem that, since a construction was adopted in which Wmax>L, the pressure Pmax acting on non-adhering part 107 could not be made sufficiently small, making the lamp liable to fail.

To take a specific numerical example, in the case of a lamp 130 manufactured by the conventional method in which the electrode rod 102*a* was of diameter d=0.9 mm and the external diameter in the portion where the coil 102*b* was wound was L=1.4 mm, the maximum width Wmax of the gap between electrode 102 and the glass constituting side tube 111 was about 1.5 mm. In this case if a small hole is provided in light-emitting section 100 and the pressure within light-emitting section 100 is increased by feeding high-pressure gas in from this hole, destruction of lamp 130 is caused when the pressure of the high-pressure gas fed into light-emitting section 100 reaches about 120 atmospheres.

As to the lamp formed by electrode 102 having electrode rod 102*a* but having no coil 102*b*, an internal diameter rw of the reduced-diameter section 113 shown FIG. 8A, can only be reduced to d+Δd (d=diameter of electrode rod 102*a*). According to the present technology Δd is equal to 0.4 mm, but Δd can be as small as 0.1 mm. Theoretically the internal diameter rw can be made smaller than d+0.4 mm, such as to d+0.1 mm, but practically, from the view point of the present technology, the internal diameter rw is preferably d+0.4 mm as explained below.

When the internal diameter rw is made smaller than d+0.4 mm, a gap between the glass and the electrode 102 (electrode rod 102*a*) becomes so small that it will be very difficult to insert the electrode 102 (electrode rod 102*a*) through the reduced-diameter section 113, resulting in low productivity. Furthermore, when the internal diameter rw is made small, it will be very difficult to insert the material 120 in the light-emitting section 100. However, when the technology for inserting the electrode 102 (electrode rod 102*a*) as well as the material 120 is improved, the internal diameter rw can be made as small as d+0.1 mm.

It is an object of the present invention to solve the above problems and to provide a high-pressure discharge lamp of the double-ended type having a construction that is not liable to fail and a method of manufacturing the high-pressure discharge lamp.

SUMMARY OF THE INVENTION

In order to achieve the above object, according to the present invention there is provided a method for manufacturing a high-pressure discharge lamp having a center glass bulb defining a light-emitting section and side tubes extending on both sides thereof, an electrode assembly sealed in each of said side tubes, said electrode assembly having an electrode and a metal foil with the electrode connected to one end, said method comprising: inserting said electrode assembly such that one end of the electrode which is not connected to the metal foil is positioned in the light-emitting section, and reducing the internal diameter of the tube surrounding the electrode.

Also, the reducing of the internal diameter of the side tube surrounding the electrode is performed by substantially uniformly heating the side tube and compressing it from the outside.

Alternatively, the internal diameter of the side tube surrounding the electrode is reduced by maintaining the interior of the glass bulb in which the electrode assembly is inserted in a condition below atmospheric pressure and heating the side tube surrounding the electrode substantially uniformly.

Also, the reducing of the internal diameter of the side tube surrounding the electrode is performed by forming built-up thickness of the glass by heating the side tube substantially uniformly and performing mutual approach and separation movements of the side tube and the light-emitting section.

Also, in a high-pressure discharge lamp according to the present invention, the maximum width Wmax of the gap between the electrode and the glass present around the electrode in the interval from the junction of the electrode and the metal foil to the boundary region of the light-emitting section and the side tube is $d<Wmax<L$ wherein the maximum diameter of the electrode is L and its minimum diameter is d.

When the electrode is made of a rod having a diameter d and without having a coil, the maximum width Wmax is $d<Wmax<d+\Delta d$, wherein $0.1\ mm<\Delta d<0.4\ mm$.

DESCRIPTION OF THE PREFERRED EMBODIMENTS

Embodiments of the present invention are described in detail below with reference to the drawings.

(First Embodiment)

A first embodiment of a high-pressure discharge lamp according to the present invention is described below using the drawings.

Figure 1A:
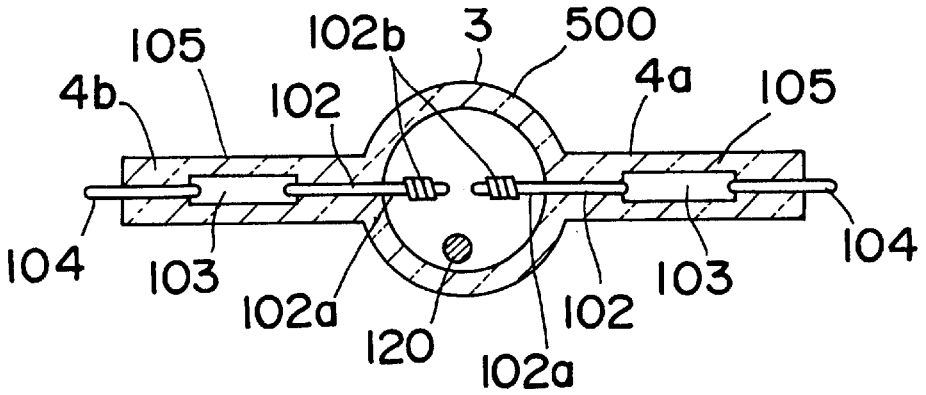
FIG. 1A is views showing the construction of a high-pressure discharge lamp according to a first embodiment of the present invention.
Figure 1B:
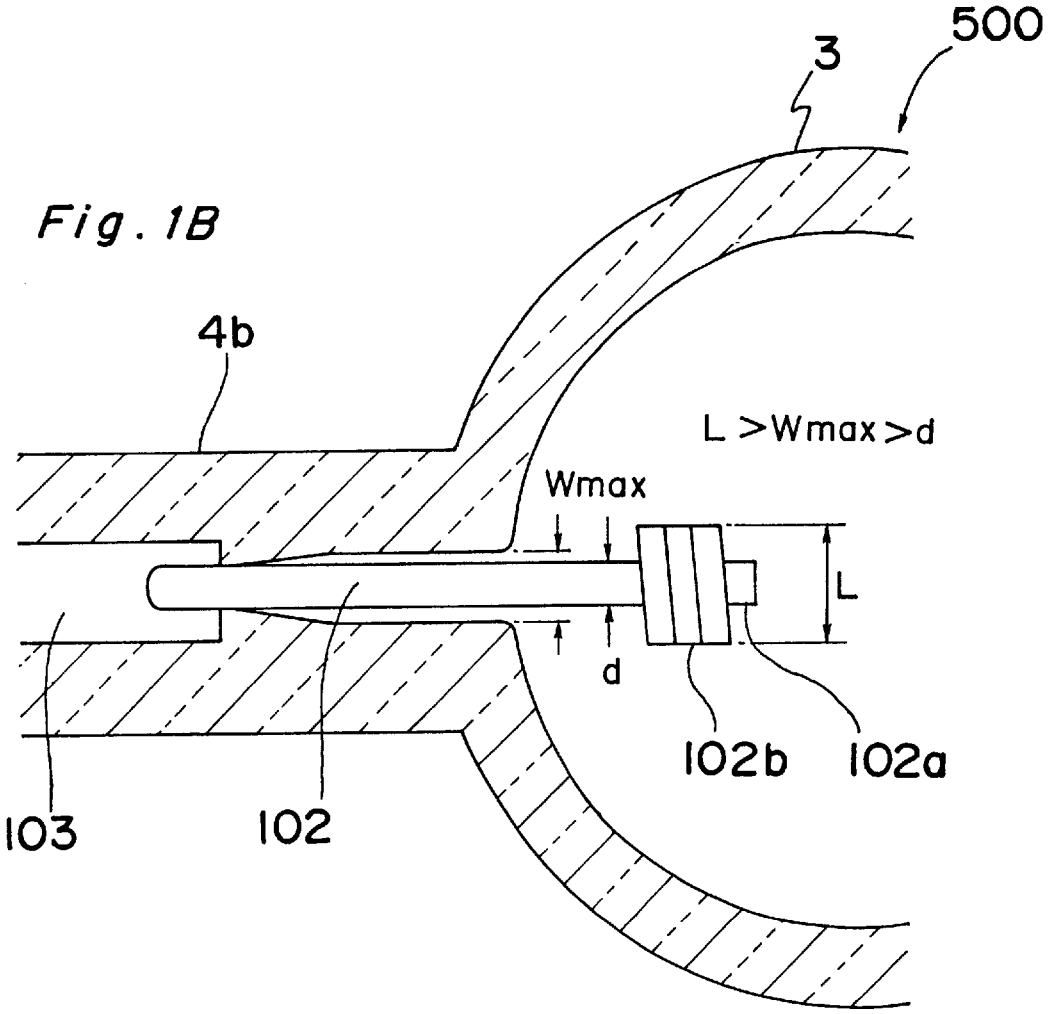
FIG. 1B is an enlarged view of a portion of the high-pressure discharge lamp of FIG. 1A.

FIGS. 1A and 1B are views showing a high-pressure discharge lamp 500 according to a first embodiment of the present invention.

In FIG. 1, reference number 3 is a light-emitting section consisting of glass, and 4*a*, 4*b* are side tubes consisting of glass that extend respectively from light-emitting section 3 and wherein are sealed a pair of electrode assemblies 105 of the same construction and shape as in the case of the prior art high-pressure discharge lamp. Within light-emitting section 3, just as in the case of the prior art high-pressure discharge lamp, there is sealed a sealed-in material 120 consisting of mercury and/or metal halide.

FIG. 1B is a detailed view of the boundary region of light-emitting section 3 and side tube 4*b* (or 4*a*) in FIG. 1A.

The construction of lamp 500 of this first embodiment is characterized in that the maximum width of a gap between electrode 102 and the glass constituting side tube 4*b* (or 4*a*) at the region of the boundary of light-emitting section 3 and side tube 4*b* (or 4*a*) is smaller than the diameter L=1.4 mm (>d) at the part of electrode 102 having the maximum diameter on the side projecting into the light-emitting section 3, i.e. the part where coil 102*b* is wound onto electrode rod 102*a* of diameter d+0.9 mm(L>Wmax>d).

Taking specific numerical values, the maximum width Wmax of the gap between electrode 102 and the glass constituting side tube 4*b* (or 4*a*) is about 0.95 mm for an external diameter L=1.4 mm of the part where coil 102*b* is wound onto electrode rod 102*a* of diameter d=0.9 mm.

In order to confirm the strength of the lamp 500 of this embodiment in respect of cracking, a small hole was formed in the light-emitting section 3, the pressure within the light-emitting section 3 was increased by feeding high-pressure gas in from this hole and the pressure at which the lamp broke was measured. As a result, it was found that the lamp 500 broke when the high-pressure gas that was fed into light-emitting section 3 reached a pressure in the vicinity of about 160 atmospheres.

Comparing this result and the result of the prior art lamp 130 having an external diameter L=1.4 mm of the part where coil 102*b* is wound onto electrode rod 102*a* of the same diameter d=0.9 mm which broke, the pressure of the high-pressure gas fed into the light-emitting section reached a pressure in the vicinity of about 120 atmospheres, it can be seen that the lamp of this first embodiment, which is substantially the same as the prior art lamp 130 in regard to the rest of its construction (the operation and/or light-emitting performance, etc. of lamp 500 of this first embodiment are therefore the same as those of the prior art lamp 130) except for the fact that the maximum width Wmax of the gap between electrode 102 and the glass constituting the side tube is smaller, is a lamp which is more difficult to break.

Thus, as described above, a lamp according to the first embodiment having a construction wherein the maximum width Wmax of the gap between electrode 102 and the glass constituting the side tube is smaller than the maximum diameter of electrode 102 on the side where it projects into light-emitting section 3, i.e. the diameter L(>d) of the part where coil 102*b* is wound onto electrode rod 102*a* of diameter d (L>Wmax>d), has the characteristic that the stress concentration acting at the non-adhering part at the periphery of electrode 102 is smaller than for the prior art lamp (Wmax>L) having an electrode 102 of the same construction and is less liable to crack.

The following embodiments are examples of methods of manufacturing a high-pressure discharge lamp according to the present invention as illustrated in the first embodiment.

(Second Embodiment)

FIGS. 2A to 2F are views given in explanation of a second embodiment of a method of manufacturing a high-pressure discharge lamp according to the present invention.

Figure 2A:
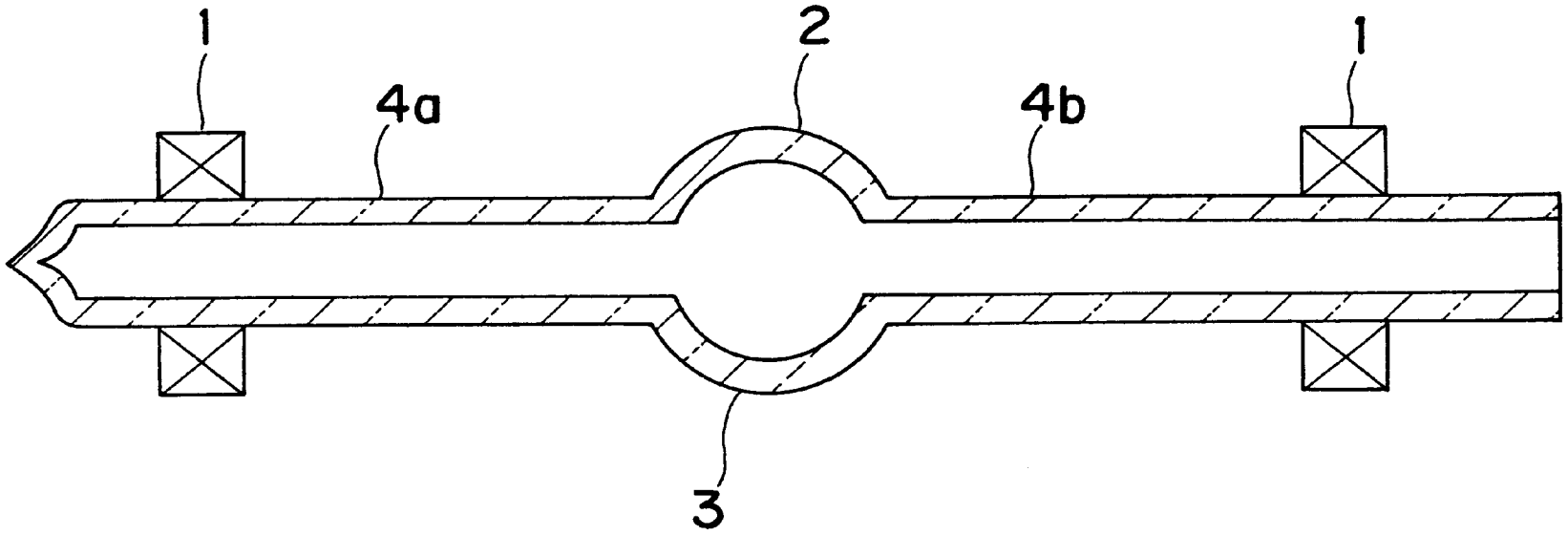
FIGS. 2A, 2B, 2C, 2D, 2E and 2F are views showing the construction steps of a high-pressure discharge lamp according to a second embodiment of the present invention.

Element 2 in FIG. 2A is a glass bulb manufactured in a separate step and has a light-emitting section 3 that is formed in a prescribed shape by heating and thermal expansion of a quartz glass tube and side tubes 4*a*, 4*b* consisting of quartz glass tubes extending from the side ends of light-emitting section 3. The end of one side tube 4*a* is sealed. The two ends of side tubes 4*a*, 4*b* of this glass bulb 2 are held so as to be capable of rotation and of being made to approach or recede from each other by a chuck 1.

Figure 2B:
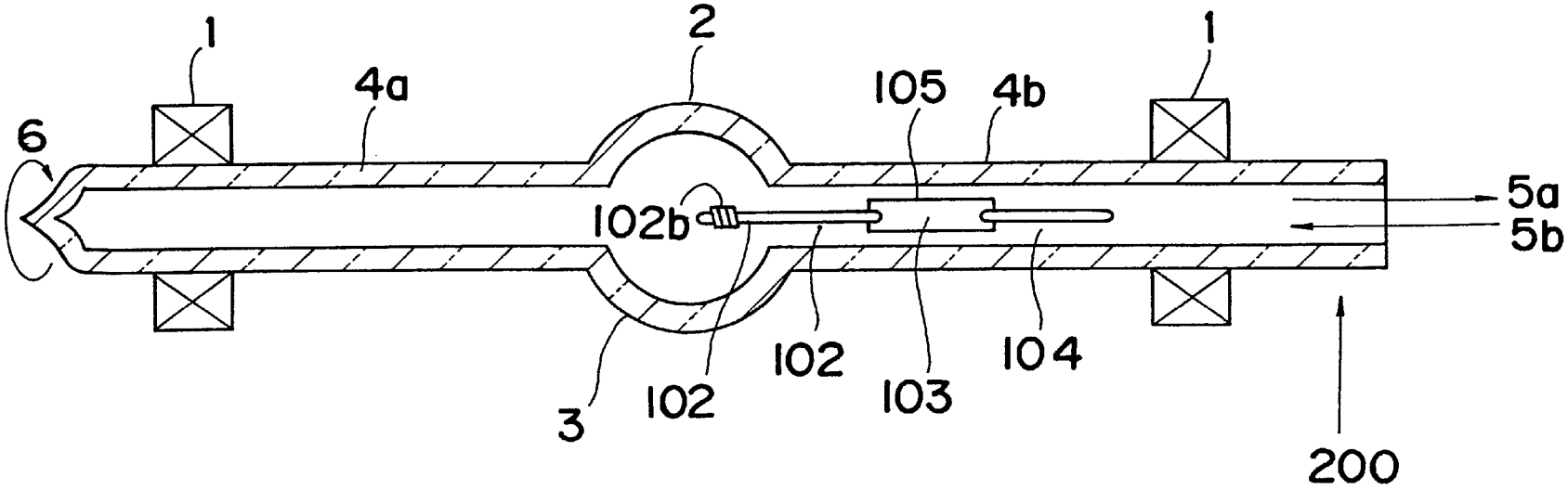

Next, as shown in FIG. 2B, an electrode assembly 105 which is identical with that shown in FIG. 1A is inserted into side tube 4*b* such that the end part, on which is wound the coil 102*b* of electrode 102, constituting a part of the electrode assembly 105, is arranged within light-emitting section 3. In this condition, as shown by the arrow 6, the glass bulb 2 is rotated by the chuck 1. Then, as shown by arrow 5*a*, the interior of glass bulb 2 is evacuated, and argon gas having a pressure of 200 mbar is sealed therein as generally indicated by arrow 5*a*. The vicinity of the end of side tube 4*b* which is not yet sealed is then sealed by heating with a burner 200, generally shown by arrow 200.

Figure 2C:
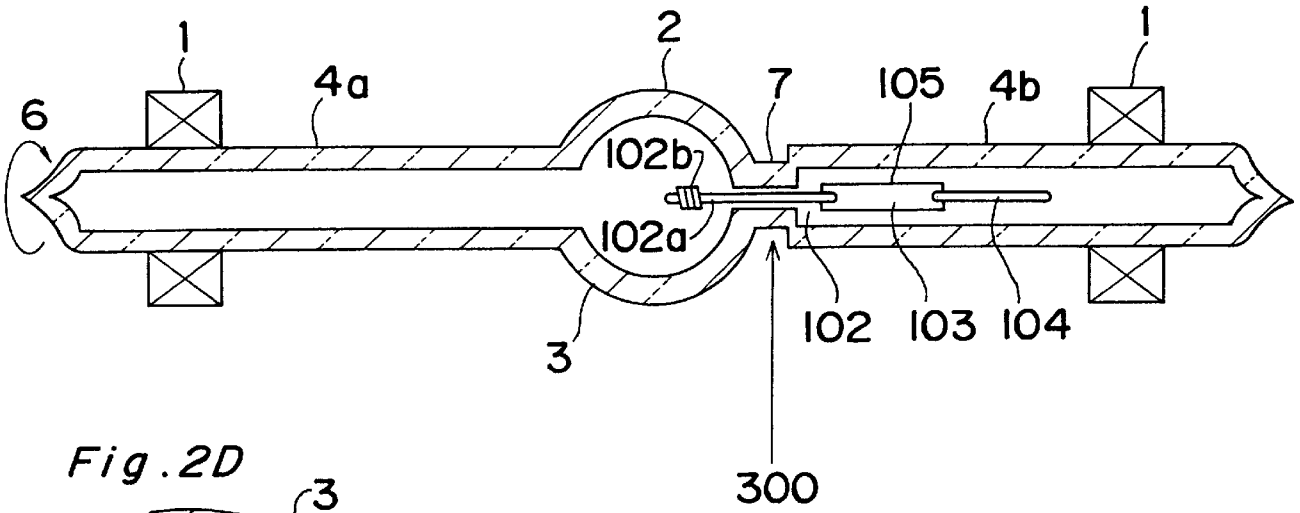

Next, as shown in FIG. 2C, the interval between the boundary region of the light-emitting section 3 and side tube 4*b* and the junction of electrode 102 and molybdenum foil 103 is now heated and softened over an appropriate length (elongated portion) by a burner constituting a heating element and generally indicated by arrow 300.

Since in this process, the pressure within the glass bulb 2 is below atmospheric, as the heated part is softened, the internal diameter of side tube 4*b* at the location where the heating takes place is reduced.

Figure 2D:
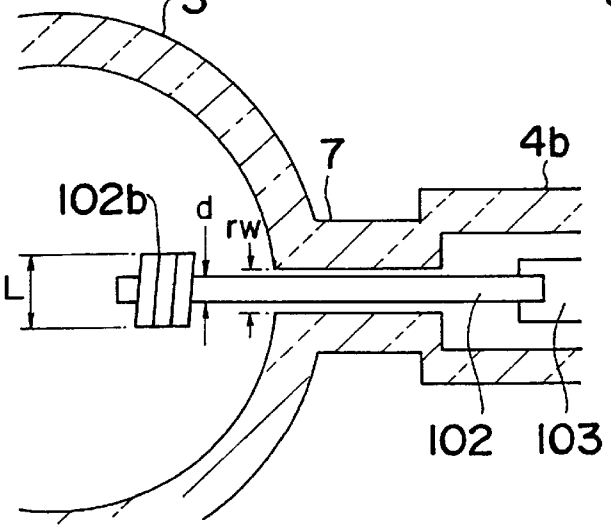

As shown in FIG. 2D, heating by the burner 300 is stopped at the point where the internal diameter of side tube 4*b* has shrunk to rw which is smaller than the diameter L, where the coil 102*b* is wound on the electrode 102 and is preferably in the approximate vicinity of the diameter d of electrode rod 102*a* constituting electrode 102. A reduced-diameter section 7 is thus formed (see the detail view).

Figure 2E:
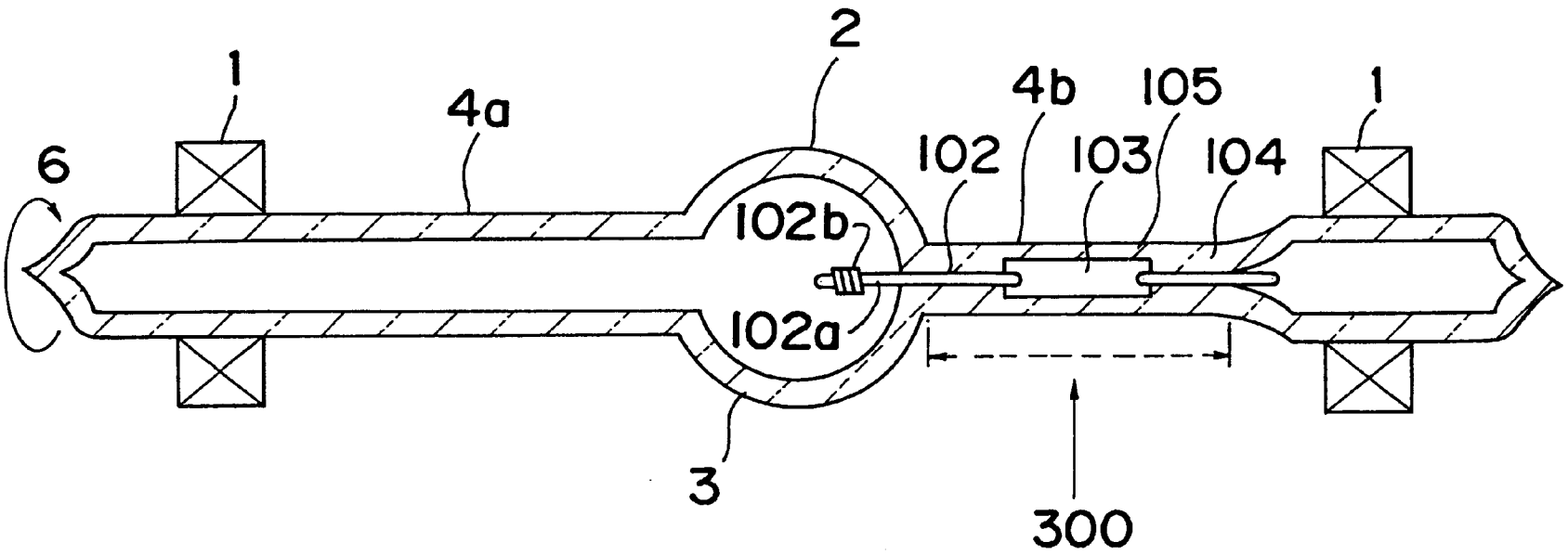

Next, as shown in FIG. 2E, heating is performed by the burner generally indicated by arrow 300 over a suitable length from the vicinity of reduced-diameter section 7 (near molybdenum foil 103) as far as external lead 104 in order to sufficiently soften the glass at the location of molybdenum foil 103. Since in this process the pressure within glass bulb 2 is below atmospheric, as the heated part is softened, the internal diameter of side tube 4*b* at the location where the heating takes place is reduced. When sufficient reduction in diameter has taken place to maintain air-tightness at molybdenum foil 103, heating is discontinued, completing the air-tight sealing of electrode assembly 105 at the side tube 4*a*.

Figure 2F:
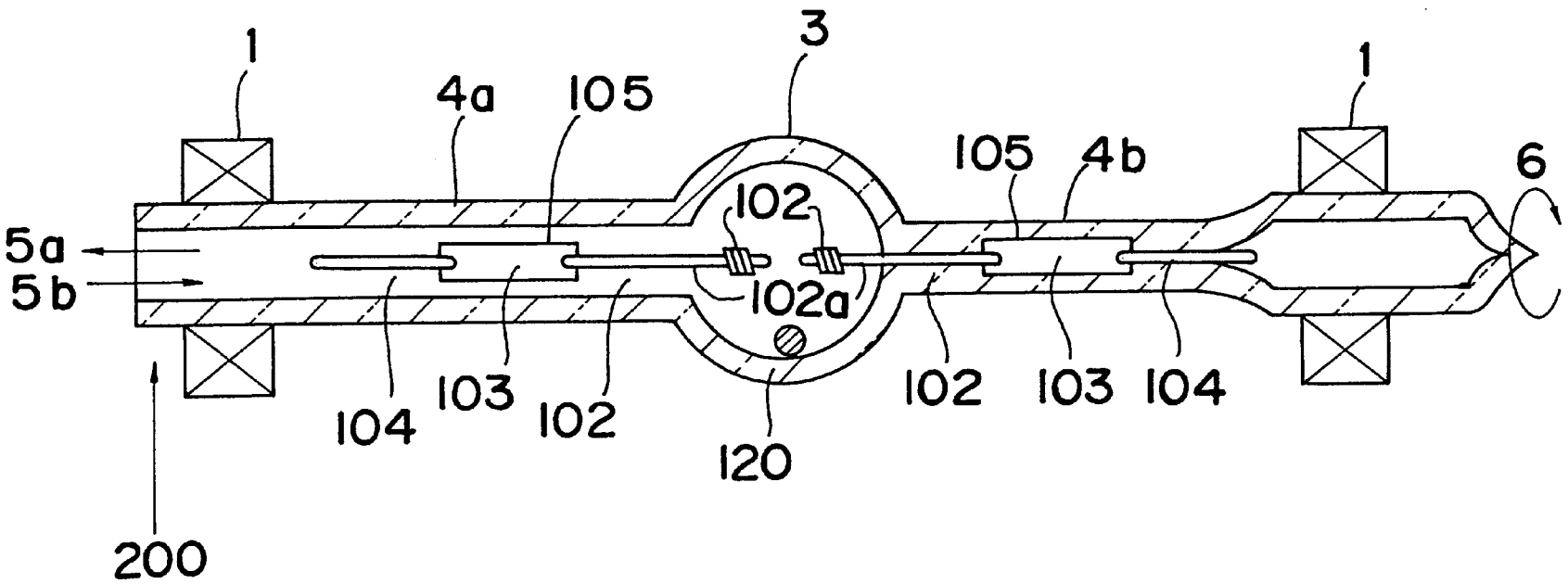

Next, as shown in FIG. 2F, the sealed end of side tube 4*a* is opened by being cut off and sealed-in material 120 such as mercury and/or metal halide is inserted into light-emitting section 3 and simultaneously the rest of electrode assembly 105 is arranged within side tube 4*a* just as in FIG. 2E. In this condition, the glass bulb 2 is rotated by the chuck 1 as shown by the arrow 6. Then, as shown by arrow 5*a*, the interior of glass bulb 2 is evacuated and argon gas at a pressure of 200 mbar is sealed therein as generally shown by arrow 5*b*. The vicinity of the open end of tube 4*a* is then sealed by heating using burner 200 as generally shown by arrow 200.

After this, as shown in FIG. 2C and FIG. 2E, the interval between the boundary of light-emitting section 3 and side tube 4*a* and the junction of electrode 102 and molybdenum foil 103 is now heated and softened over an appropriate length (elongated portion) using a heating element constituted by a burner generally indicated by arrow 300 so as to form a reduced-diameter section 7 by shrinking the internal diameter of side tube 4*a* about as far as the diameter of electrode rod 102*a* of the electrode 102. The glass is then heated and softened over an appropriate length from the vicinity of reduced-diameter section 7 (from molybdenum foil 103) as far as external lead 104 to thereby perform air-tight sealing of electrode assembly 105.

If, after reducing the diameter of the boundary region of light-emitting section 3 and side tube 4*a* and sealing a pair of electrode assemblies 105 into side tubes 4*a*, 4*b*, the ends of side tubes 4*a*, 4*b* are cut off and removed such that external leads 104 do not project to the outside, a high-pressure discharge lamp 500 according to the first embodiment as shown in FIG. 1 is finally obtained.

It should be noted that, in the second embodiment, in order to achieve reliable air-tight sealing of the pair of electrode assemblies 105 in side tubes 4*a*, 4*b*, particularly at the location of the molybdenum foil 103, it would be possible, when the glass (side tubes 4*a*, 4*b*) is softened, to seal the electrode assemblies 105 in the side tubes 4*a*, 4*b* by gripping the side tubes with a pair of gripping elements or by clamping the side tubes flat by applying pressure.

Further, in the second embodiment while effecting air-tight sealing of the electrode assemblies 105, the region of the side tubes 4*a*, 4*b* covering the molybdenum foil 103 was sufficiently heated and softened after forming the reduced-diameter section 7, such that if the reduced-diameter section 7 is formed after inserting the electrode assemblies 105 into side tubes 4*a*, 4*b*, reduced-diameter section 7 could be formed, for example, by reducing the diameter of side tube 4*a* (or 4*b*) by heating the vicinity of the boundary of light-emitting section 3 and side tube 4*a* (or 4*b*) after sufficiently heating and softening the region of the side tubes 4*a*, 4*b* covering the molybdenum foil 103 to complete the air-tight sealing.

Also, when the reduced-diameter section is formed in the vicinity of the boundary of light-emitting section 3 and side tube 4*a* in a situation where the sealed-in material 120 is already inserted or when a electrode assembly 105 is sealed into side tube 4*a*, in order to prevent the sealed-in material 120 from being evaporated by the heat of the burner there would be no problem with cooling part of the light-emitting section 3 by, for example, blowing liquid nitrogen onto it.

In FIG. 2C, even without a burner 300, there would be no problem in moving burner 200 to provide the heating element used for forming the reduced-diameter section 7.

Figure 3:
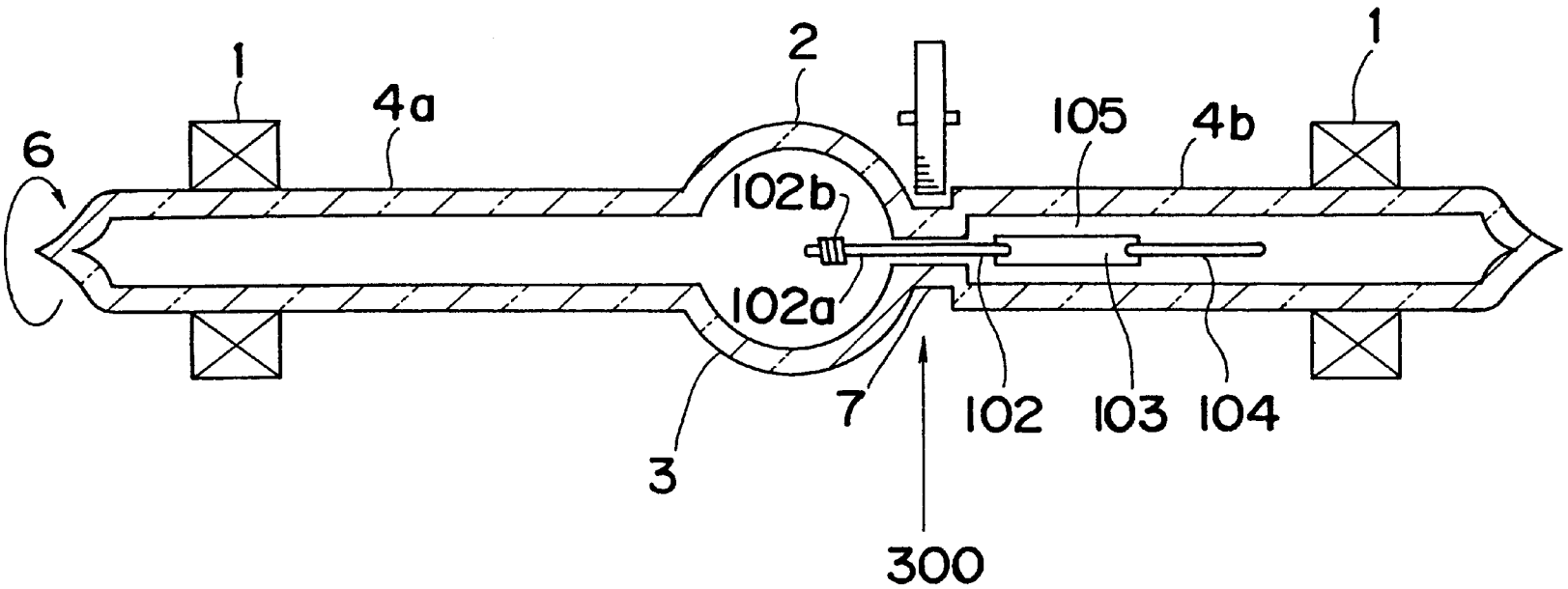
FIG. 3 is a view showing a step of reducing the diameter of a boundary region of a light-emitting section and side tube according to the present invention.

Further in FIG. 2C, at the stage of forming reduced-diameter section 7, in order to assist in the diameter reduction of the internal diameter of tube 4*b*, the reduced-diameter section 7 could be formed by compressing the heated portion with a freely rotatable heat-resistant carbon roller 77, for example, as shown in FIG. 3. In this case, there could be a plurality of carbon heads 77 for forming the reduced-diameter section 7 and the reduced-diameter section 7 could be formed in a mode such that compression is effected at a plurality of locations on the periphery of the part where the reduced-diameter section 7 is to be formed.

Figure 4:
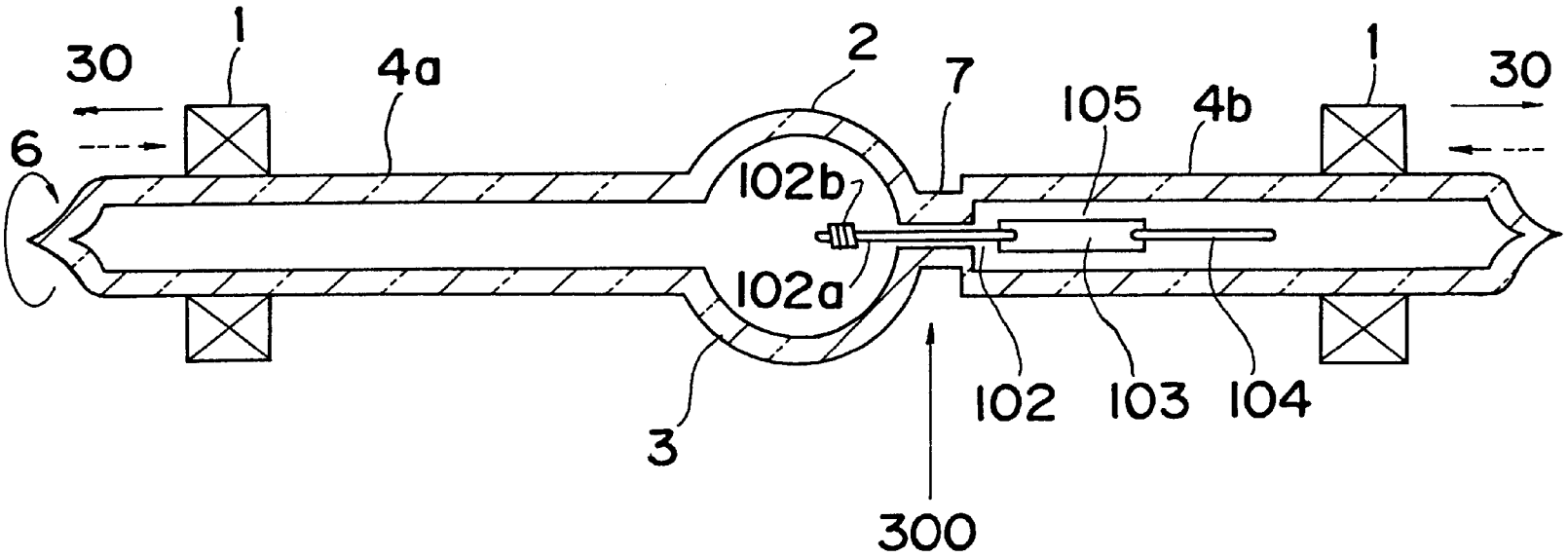
FIG. 4 is a view showing a step of reducing the diameter of a boundary region of a light-emitting section and side tube according to the present invention.

Alternatively, as shown in FIG. 4, when the glass has softened, by making the light-emitting section 3 and side tube 4*b* gradually approach each other while executing approach and separation movements by mutual movements of chucks 1, as shown by arrow 300, built-up thickness portions of the glass can be formed in the locations where softening has occurred. Such built-up thickness portions of the glass grow towards the interior, so they assist in diameter reduction of the side tube 4*b*.

In the second embodiment above, an example was described in which in order to heat side tubes 4*a*, 4*b* uniformly, the glass bulb 2 was rotated. However, it would be possible, instead of rotating glass bulb 2, to adopt a configuration in which the burner 300 is arranged to rotate in the circumferential direction around the side tubes or to adopt a configuration in which the periphery of the side tubes is heated by a plurality of burners.

Figure 5:
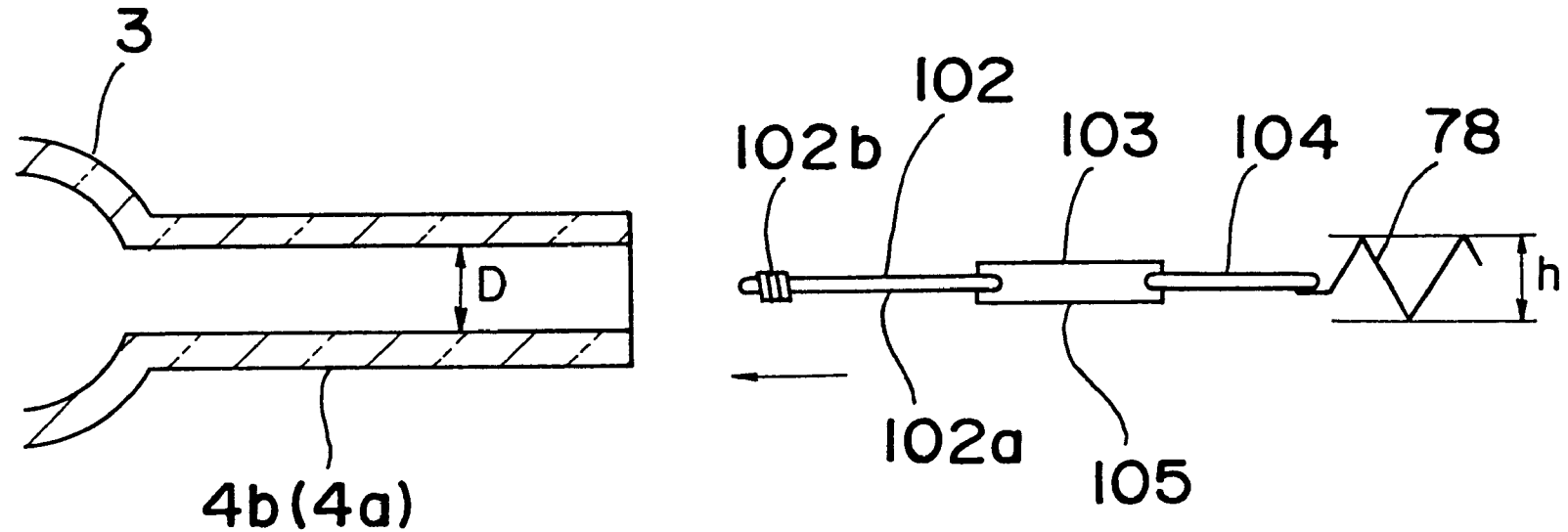
FIG. 5 is a view showing a method of fixing an electrode assembly.

In the second embodiment, a case was described in which electrode assemblies 105 were fixed and arranged within side tubes 4*a*, 4*b*. Whether or not electrode assemblies 105 are held within side tubes 4*a*, 4*b* has no effect on the benefits of the present invention but, as shown for example in FIG. 5, by connecting thin metal foils 78 of, for example, molybdenum bent such that their overall length h is slightly larger than the internal diameter D of side tube 4*b* (or 4*a*) and inserting them in the side tubes 4*b* (or 4*a*) at one end of external lead 104, positional alignment of electrode assemblies 105 could be effected by frictional coupling of the portions where metal foils 78 are bent and the side tube 4*b* (or 4*a*). In this case, a further benefit is obtained because the accuracy of arrangement within the light-emitting section 3 and/or the inter-electrode distance can be improved.

(Third Embodiment)

Next, a third embodiment of a method of manufacturing a high-pressure discharge lamp according to the present invention is described with reference to FIGS. 6A to 6D.

Figure 6A:
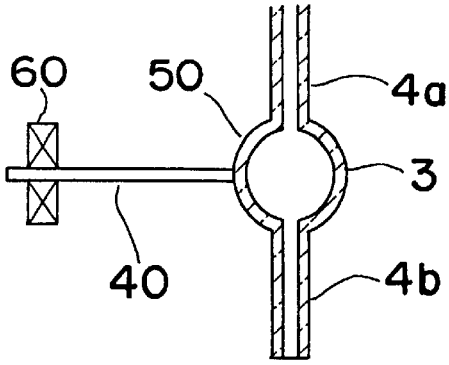
FIGS. 6A, 6B, 6C and 6D are views showing construction steps of a high-pressure discharge lamp according to a third embodiment of the present invention.

In FIG. 6A, a high-pressure discharge lamp 50 has joined to it a comparatively fine quartz glass tube 40 for evacuating the interior of the light-emitting section 3 of the glass bulb 2 and for inserting the material 120 described in the second embodiment into light-emitting section 3. This glass tube 40 for evacuation and insertion is held by a chuck 60 and bulb 50 is arranged such that side tubes 4*a*, 4*b* extend in the vertical direction.

Figure 6B:
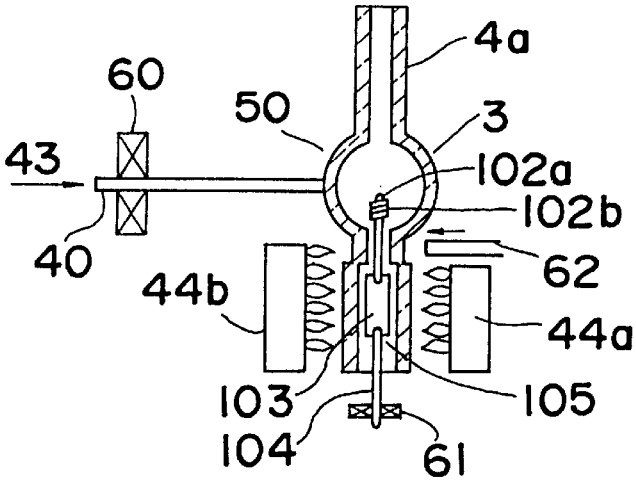

Next, as shown in FIG. 6B, an electrode assembly 105 is inserted into the side tube 4*b* that is positioned on the lower side such that the end of electrode 102 on which coil 102*b* is wound, is arranged within the light-emitting section 3. The positional relationship of the electrode assembly 105 and side tube 4*b* is then fixed by holding an external lead 104 by a chuck 61. Also, as shown by the arrow 43, inert gas consisting of argon gas is introduced by evacuation glass tube 40. In this condition, a pair of burners 44*a*, 44*b* are lit and side tube 4*b* is heated while rotating the burners 44*a*, 44*b* about the circumference, centered on side tube 4*b*. In this process, at least one of the burners 44*a*, 44*b* (burner 44*b* in FIG. 6B) is arranged such that the boundary region of side tube 4*b* and light-emitting section 3 is heated.

When the boundary region of side tube 4*b* and light-emitting section 3 have become soft, it is subjected to pressure by a carbon head 62 so that the internal diameter of the side tube 4*a* (or 4*b*) at this part (elongated portion) is reduced. This carbon head 62 is rotated about side tube 4*b* in the same way as burners 44*a*, 44*b*.

Just in case of FIG. 2D, compression of side tube 4*b* by carbon head 62 is discontinued at the point where the internal diameter rw of side tube 4*b* has shrunk to, at least, smaller than the diameter L of the location where coil 102*b* of electrode 102 is wound on and preferably, to the approximate vicinity of the diameter d of the electrode rod 102*a* constituting electrode 102. The formation of the reduced-diameter section 7 is thus completed.

Figure 6C:
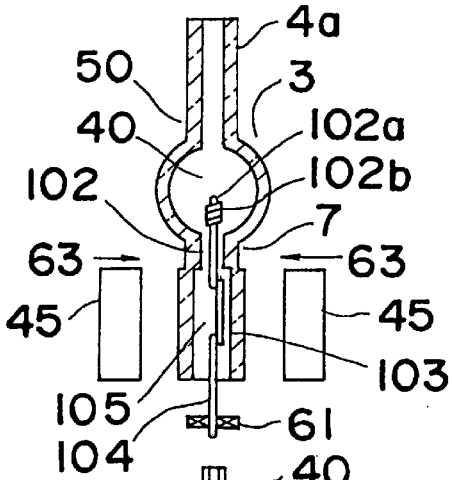

Then, as shown in FIG. 6C, after the location of molybdenum foil 103 has reached a sufficiently heated condition, heating by burners 44*a* and 44*b* and rotation of burners 44*a*, 44*b* and carbon head 62 are now discontinued and, as shown in by arrow 63, side tube 4*b* is immediately gripped in the thickness direction of the molybdenum foil 103 constituting a part of the electrode assembly 105 and compressed by a pair of heat-resistant blocks 45 so that electrode assembly 105 is sealed in an air-tight manner in side tube 4*a* (or 4*b*).

Figure 6D:
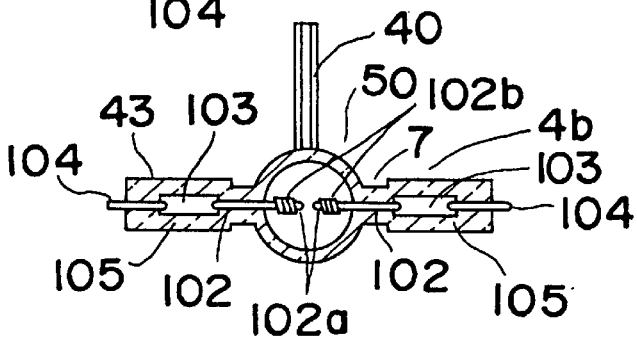
Figure 7A:
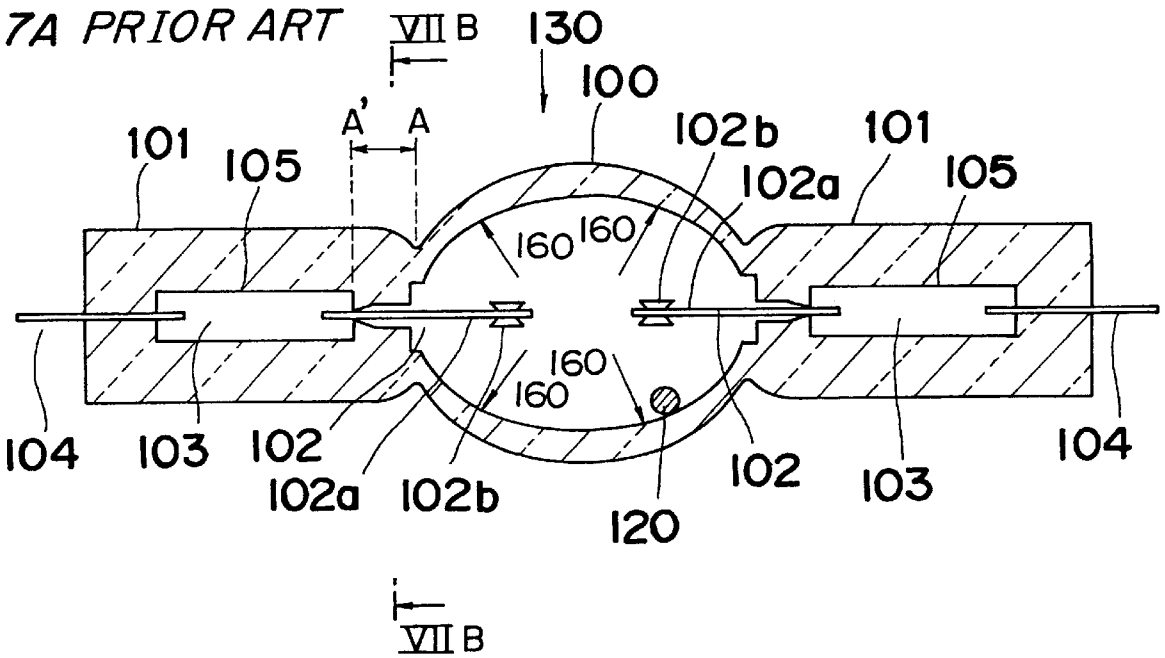
Fig. 7A PRIOR ART
FIGS. 7A and 7B are views showing the construction of a prior art high-pressure discharge lamp.
Figure 7B:
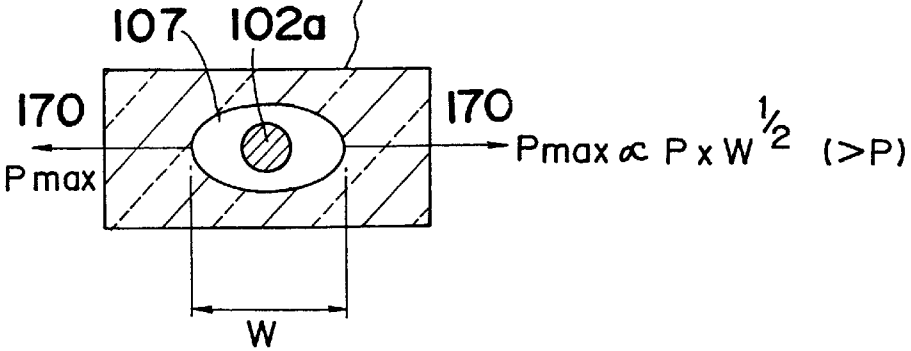
Fig. 7B PRIOR ART
Figure 8A:
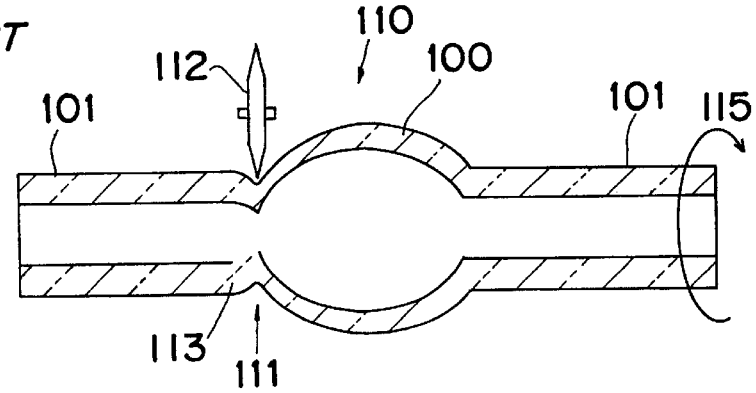
Fig. 8A PRIOR ART
FIGS. 8A, 8B, 8C and 8D are views showing a method of manufacturing a prior art high-pressure discharge lamp.
Figure 8B:
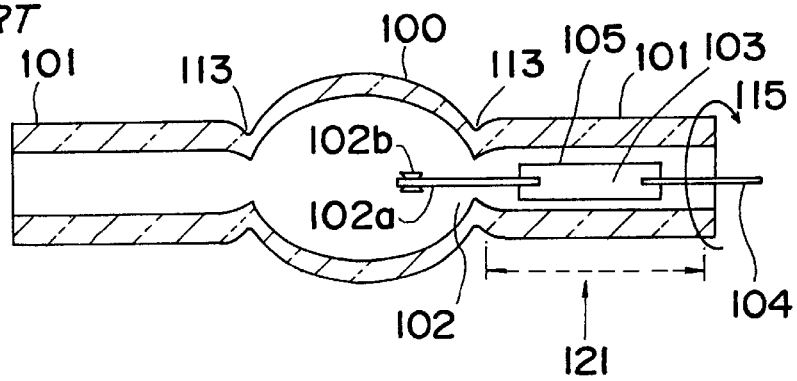
Fig. 8B PRIOR ART
Figure 8C:
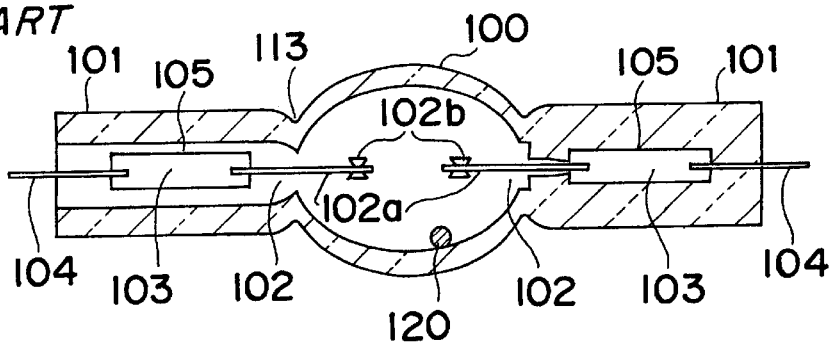
Fig. 8C PRIOR ART
Figure 8D:
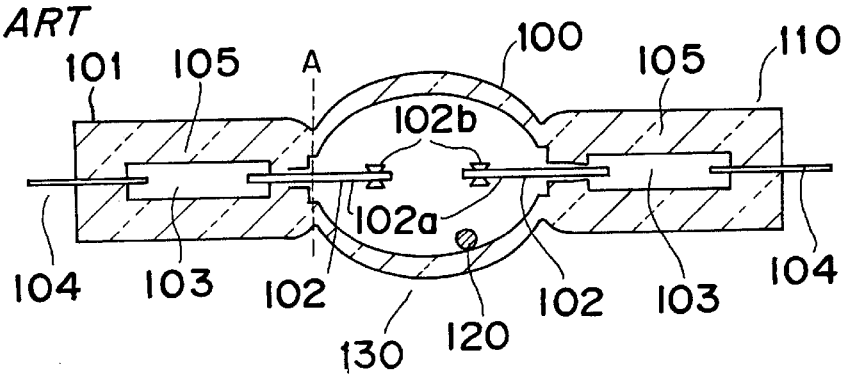
Fig. 8D PRIOR ART
Figure 9:
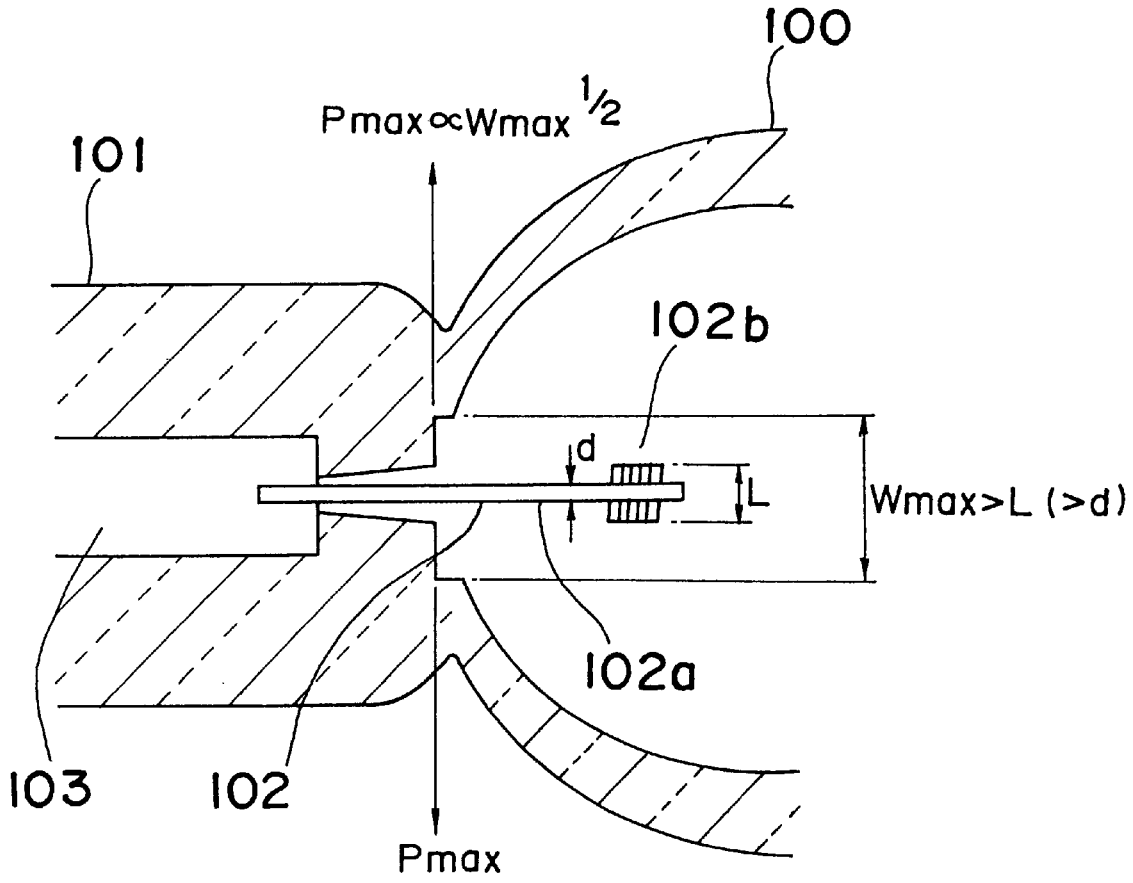
Fig. 9 PRIOR ART
FIG. 9 is a detailed view of the boundary region of a light-emitting section and side tube of a prior art high-pressure discharge lamp.

Next, the hold of the chuck 61 is released and the glass bulb 50 vertically inverted so that formation of reduced-diameter section 7 and air-tight sealing of electrode assembly 105 can be effected with respect to the remaining side tube 4*a*. Thereupon, as shown in FIG. 6D, a glass bulb 50 is completed which has a construction wherein, just as in the case of the high-pressure discharge lamp 500 according to the first embodiment of the present invention, the maximum width Wmax (FIG. 1B) of the gap between electrode 102 and glass constituting the side tube is smaller than the maximum diameter of electrode 102 on the side where it projects into light-emitting section 3, i.e. the diameter L(>d) of the location where coil 102*d* is wound onto electrode rod 102*a* of diameter d (L>Wmax>d).

Next, although not shown in the drawings, the sealed-in material 120 is introduced into light-emitting section 3 from evacuation glass tube 40, the light-emitting section 3 is evacuated, a prescribed amount of sealed-in gas is inserted in light-emitting section 3 and evacuation glass tube 40 is sealed off. In this way, a high-pressure discharge lamp of the double-ended type identical to the high-pressure discharge lamp 500 shown in FIGS. 1A and 1B can be obtained having the characteristics that the stress concentration acting at the non-adhering part created around the circumference of electrode 102 is smaller than in the case of a prior art lamp (Wmax>L) having an electrode 102 of the same construction and therefore that it is less liable to break.

Although in this embodiment a pair of rotating burners was employed, the number of burners is not restricted to this. Also, a method could be adopted in which formation of reduced-diameter section 7 and the air-tight sealing of the electrode assembly 105 are performed by inserting the electrode assembly 105 into the side tube 4*a* (or 4*b*) positioned above.

Also, reduced-diameter section 7 could be formed in a mode in which there are a plurality of carbon heads 62 for forming reduced-diameter section 7, such that compression is effected at a plurality of locations of the circumference of the part which the reduced-diameter section 7 is to be formed.

It should be noted that, although in the second and third embodiments examples were described in which the shapes of side walls 4*a*, 4*b* of the glass bulb 2 were straight tubes prior to the diameter reduction, if one end of the side where coil 102*b* is wound onto electrode 102 can be arranged within the light-emitting section 3, a shape could be adopted in which the rest of the shape, for example the portion where the light-emitting section and side tube are adjacent, is of reduced diameter for the beginning. In this case, the further benefit is obtained that positional alignment of the tip of electrode 102 within the light-emitting section 3 is facilitated.

Also there are no restrictions on the shape of electrode rod 102*a* and coil 102*b* constituting electrode 102 and electrode 102 could be of a construction in which electrode rod 102*a* and coil 102*b* are integrally formed. Further, there are no problems if the external lead 104 is connected to one end of the molybdenum foil 103 at the stage of formation of the reduced-diameter section 7.

Also, although in the second and third embodiments examples were described in which burners were employed as the heating element for heating the glass, other types of heating elements such as radio-frequency inductive heating elements and/or lasers could be employed. Radio-frequency inductive heating elements and/or lasers do not require oxygen, so manufacturing comprising heating can be performed in an atmosphere of a dried inert gas, so further benefit is obtained that admixture of impurities (moisture) into the lamp can be prevented, thus extending the life of the lamp.

Also, although in the second and third embodiments examples were described such that the electrode 102 is formed by the electrode rod 102*a* and coil 102*b*, but the present invention is also applicable to an electrode which has no coil 102*b*, but only the electrode rod 102*a*. After the electrode 102 (electrode rod 102*a*) and the material 120 are inserted in the light-emitting section 3, it is possible, according to the present invention, to reduce the internal diameter rw of the reduced-diameter section 7 to less than d+Δd (d=diameter of electrode rod 102*a*), wherein 0.1 mm≦Δd≦0.4 mm, and preferably Δd=0.4 mm.

Preferred embodiments of the present invention have been described above, but this description is not limitative and various modifications are, of course, possible. The method of manufacturing and lighting a high-pressure discharge lamp according to the present invention illustrated in the embodiments is by way of example. The scope of the invention is determined by the claims.

As described above with reference to embodiments, according to the present invention, the internal diameter of a side tube enclosing an electrode is reduced in a condition in which an electrode assembly is inserted in the side tube, so the internal diameter of the side tube can be reduced to the diameter of the electrode positioned in the reduced diameter part. Consequently, an excellent high-pressure discharge lamp of the double-ended type which is resistant to breakage can be provided.

What is claimed is:

1. A method for manufacturing a high-pressure discharge lamp having a center glass bulb defining a light-emitting section and side tubes extending from opposite sides of the center glass bulb, the method comprising:

inserting an electrode assembly having an electrode with first and second ends and a metal foil attached to the first end of the electrode through one of the side tubes into the center glass bulb such that the second end of the electrode is positioned in the light-emitting section;

reducing an internal diameter of an elongated portion of the one of the side tubes surrounding the electrode such that the elongated portion has a substantially uniform diameter; and sealing the metal foil in the one of the side tubes after said reducing of the internal diameter.

2. A method as claimed in claim 1, wherein said reducing of the internal diameter comprises:

substantially uniformly heating the elongated portion of the one of the side tubes surrounding the electrode; and compressing the elongated portion of the one of the side tubes from outside.

3. A method as claimed in claim 2, wherein said reducing of the internal diameter further comprises inserting inert gas into the one of the side tubes to prevent oxidation of the electrode assembly.

4. A method as claimed in claim 3, wherein said inserting of inert gas comprises inserting argon gas into the one of the side tubes to prevent oxidation of the electrode assembly.

5. A method as claimed in claim 2, further comprising rotating the one of the side tubes in a direction circumferential to the one of the side tubes to achieve said substantially uniformly heating of the elongated portion of the one of the side tubes surrounding the electrode.

6. A method as claimed in claim 2, wherein said substantially uniformly heating of the elongated portion of the one of the side tubes surrounding the electrode comprises rotating a heating element in a circumferential direction around the elongated portion of the one of the side tubes surrounding the electrode.

7. A method as claimed in claim 2 wherein said substantially uniformly heating of the elongated portion of the one of the side tubes surrounding the electrode comprises substantially uniformly heating the elongated portion of the one of the side tubes surrounding the electrode with a burner.

8. A method as claimed in claim 2, wherein said substantially uniformly heating of the elongated portion of the one of the side tubes surrounding the electrode comprises substantially uniformly heating the elongated portion of the one of the side tubes surrounding the electrode with a radio-frequency inductive heating element.

9. A method as claimed in claim 2, wherein said substantially uniformly heating of the elongated portion of the one of the side tubes surrounding the electrode comprises substantially uniformly heating the elongated portion of the one of the side tubes surrounding the electrode with a laser.

10. A method as claimed in claim 1, wherein said reducing of the internal diameter comprises:

maintaining an interior of the one of the sides tubes at a pressure below atmospheric pressure; and substantially uniformly heating the elongated portion of the one of the side tubes surrounding the electrode.

11. A method as claimed in claim 1, wherein said reducing of the internal diameter comprises:

substantially uniformly heating the elongated portion of the one of the side tubes surrounding the electrode; and performing expansion and contraction movements in a direction of the light-emitting section on the one of the side tubes, thereby building up a thickness of the elongated portion of the one of the side tubes surrounding the electrode.

12. A method as claimed in claim 1, wherein said inserting of the electrode assembly having the electrode with the first and second ends comprises inserting an electrode assembly having an electrode with first and second ends, the second end having a larger diameter than the first end.

13. A method as claimed in claim 1, wherein said reducing of the internal diameter comprises reducing an internal diameter of the elongated portion of the one of the side tubes surrounding the electrode such that the internal diameter of the elongated portion of the one of the side tubes is greater than a diameter of the first end of the electrode and less than a diameter of the second end of the electrode.

* * * * *